US011486344B2

(12) United States Patent
Oh et al.

(10) Patent No.: US 11,486,344 B2
(45) Date of Patent: Nov. 1, 2022

(54) ENGINE GLOW PLUG DISCONNECTION DETECTION METHOD

(71) Applicants: Hyundai Motor Company, Seoul (KR); Kia Motors Corporation, Seoul (KR)

(72) Inventors: Jeong Sang Oh, Incheon (KR); Jin Ho Kim, Hwaseong-Si (KR); Jang Su Kim, Guri-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 40 days.

(21) Appl. No.: 17/165,634

(22) Filed: Feb. 2, 2021

(65) Prior Publication Data

US 2022/0065213 A1 Mar. 3, 2022

(30) Foreign Application Priority Data

Sep. 3, 2020 (KR) ..... 10-2020-0112260

(51) Int. Cl.
*F02P 19/02* (2006.01)
*F02D 41/14* (2006.01)

(52) U.S. Cl.
CPC ..... *F02P 19/027* (2013.01); *F02D 41/1498* (2013.01); *F02D 2200/101* (2013.01)

(58) Field of Classification Search
CPC ..... F02P 19/027; F02D 41/1498; F02D 2200/101
USPC ..... 701/113
See application file for complete search history.

(56) References Cited

U.S. PATENT DOCUMENTS 4,518,268 A * 5/1985 Swis ..... F02B 77/083 374/144

FOREIGN PATENT DOCUMENTS

| | | | | |
|---|---|---|---|---|
| EP | 0288085 A2 | * | 10/1988 | ..... F02P 7/035 |
| EP | 1321668 B1 | * | 4/2005 | ..... F02D 41/083 |
| JP | 60187770 A | * | 9/1985 | ..... F02P 19/027 |
| JP | 09291873 A | * | 11/1997 | ..... F02P 19/027 |
| JP | 2007239498 A | * | 9/2007 | |
| JP | 2010-90732 A | | 4/2010 | |
| JP | 5995993 A1 | | 7/2014 | |
| JP | 5817214 B2 | | 11/2015 | |
| KR | 100401711 B1 | * | 10/2003 | |
| KR | 10-1286995 B1 | | 7/2013 | |
| WO | WO-2012144191 A1 | * | 10/2012 | ..... F02P 19/025 |

* cited by examiner

*Primary Examiner* — Logan M Kraft
*Assistant Examiner* — Joshua Campbell
(74) *Attorney, Agent, or Firm* — Morgan, Lewis & Bockius LLP

(57) ABSTRACT

An engine glow plug disconnection detection method may include: increasing, by a controller, temperature of a plurality of glow plugs by performing a rapid temperature increase mode when an engine start signal of a vehicle is recognized by the controller; determining whether the glow plugs are disconnected and the number of disconnections using an engine start early-stage voltage of the vehicle and a voltage of the vehicle when the rapid temperature increase mode is performed, by the controller; recognizing, by the controller, cylinders of an engine with at least a disconnected glow plug upon determining that one or more glow plugs are disconnected: and storing, by the controller, a number of disconnected glow plugs and information related to corresponding cylinders.

12 Claims, 4 Drawing Sheets

| VOLTAGE DROP | NUMBER OF DISCONNECTIONS |
|---|---|
| 2.0V OR HIGHER | 0 |
| 1.6±0.1V | 1 |
| 1.2±0.1V | 2 |
| 0.8±0.1V | 3 |
| 0.4V OR LOWER | 4 |

ENGINE GLOW PLUG DISCONNECTION DETECTION METHOD

CROSS REFERENCE TO RELATED APPLICATION

The present application claims priority to Korean Patent Application No. 10-2020-0112260, filed Sep. 3, 2020, the entire contents of which is incorporated herein for all purposes by this reference.

BACKGROUND OF THE INVENTION

Field of the Invention

The present invention relates to a method of diagnosing and detecting whether there is disconnection in a glow plug of a diesel engine.

Description of Related Art

A glow plug of a diesel engine enables easy starting of the engine, generate a smooth and stable idle state, and reduce harmful substances in exhaust gas by heating air or fuel which is supplied to combustion chambers.

When such a glow plug is disconnected, the harmful substances in exhaust gas increase while an engine is operated, so it is required to rapidly determine the present situation and take appropriate measures for maintenance.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing an engine glow plug disconnection detection method that can easily, rapidly, and accurately determine disconnection of a glow plug of a diesel engine and which cylinder has a glow plug with disconnection without specific equipment when the glow plug is disconnected to be configured to induce quick and accurate maintenance.

To achieve the objectives of the present invention, an engine glow plug disconnection detection method includes: increasing, by a controller, temperature of a plurality of glow plugs by performing a rapid temperature increase mode when an engine start signal of a vehicle is recognized by the controller; determining whether the glow plugs are disconnected and the number of disconnections using an engine start early-stage voltage of the vehicle and a voltage of the vehicle when the rapid temperature increase mode is performed, by the controller; recognizing, by the controller, cylinders of an engine with at least a disconnected glow plug upon determining that one or more glow plugs are disconnected: and storing, by the controller, a number of disconnected glow plugs and information related to corresponding cylinders.

When the engine start signal of the vehicle is recognized, the controller may store a voltage of a battery in the vehicle as the engine start early-stage voltage, measure the voltage of the battery while performing the rapid temperature increase mode, determine a voltage drop of the battery from the engine start early-stage voltage when the rapid temperature increase mode is performed, and determine whether the glow plugs have been disconnected and the number of disconnections on the basis of the voltage drop.

The controller may be configured to determine the number of disconnected glow plugs by comparing the voltage drop with a predetermined disconnection map, and the disconnection map may be configured to show that the larger the voltage drop, the smaller the number of disconnected glow plugs.

The controller may be configured to determine a cylinder at which an RPM deviation of an engine RPM sensor signal is out of a predetermined range as a cylinder having a disconnected glow plug.

The controller may be configured to determine whether the number of disconnected glow plugs is the same as the number of cylinders at which the RPM deviation is out of the predetermined range, and may store the number of the disconnected glow plugs and information related to corresponding cylinders when the number of the at least a disconnected glow plug and the number of cylinders are a same.

When the number of disconnected glow plugs is not the same as the number of cylinders at which the RPM deviation is out of the predetermined range, the controller may store information indicating that the glow plugs of all cylinders have been disconnected.

When the number of cylinders at which the RPM deviation is out of the predetermined range is greater than the number of disconnected glow plugs, the controller may store information indicating that the glow plugs of all cylinders have been disconnected.

The controller may further consider a signal of a vibration sensor that can measure vibration of a cylinder block of the engine upon determining cylinders of which the glow plugs have been disconnected.

According to various exemplary embodiments of the present invention, when a glow plug is disconnected in a diesel engine, it is possible to easily, rapidly, and accurately detect the glow plug and accurately determined which cylinder the disconnected glow plug pertains to so that accurate and quick maintenance is performed. Accordingly, it is possible to reduce harmful substances in the exhaust gas from the engine and enable convenient maintenance.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
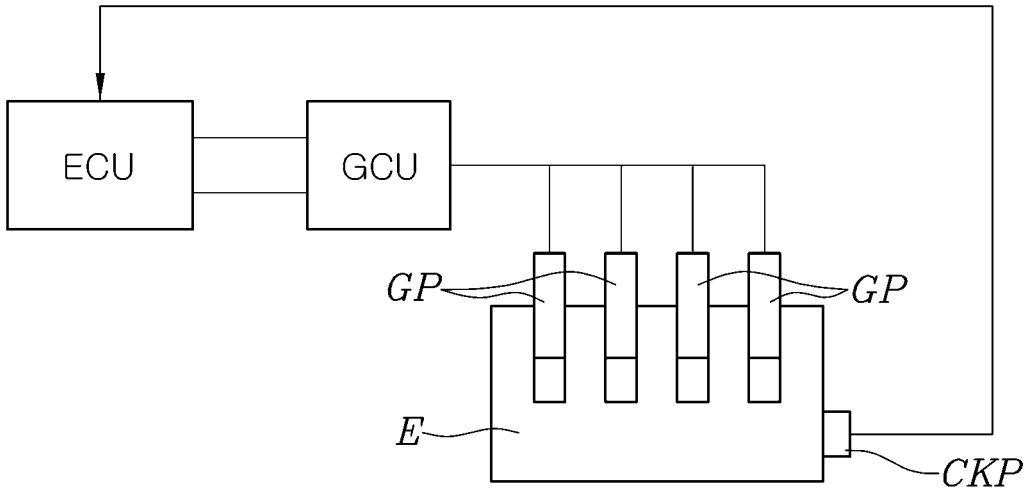
FIG. 1 is a view conceptually showing an engine to which various exemplary embodiments of the present invention may be applied.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

FIG. 1 is a view conceptually showing an engine to which various exemplary embodiments of the present invention may be applied. An engine E has a glow plug GP for each cylinder to be configured to heat air or fuel which is supplied. The glow plugs GP are configured to be controlled by a Glow plug Control Unit (GCU) which is controlled by an Engine Control Unit (ECU) and the ECU can detect the RPM of the engine by receiving the rotation speed of the crankshaft of the engine from a crank speed sensor CKP.

The glow plugs GP may be directly disposed in the combustion chambers of the cylinders, respectively, or may be disposed in the intake ports right before the combustion chambers, respectively, but it is exemplified that the glow plugs GP are disposed in the cylinders, respectively, for the convenience of description.

For reference, the ECU may be a kind of controller to be described below and the controller may mean a general device including the GCU.

Figure 2:
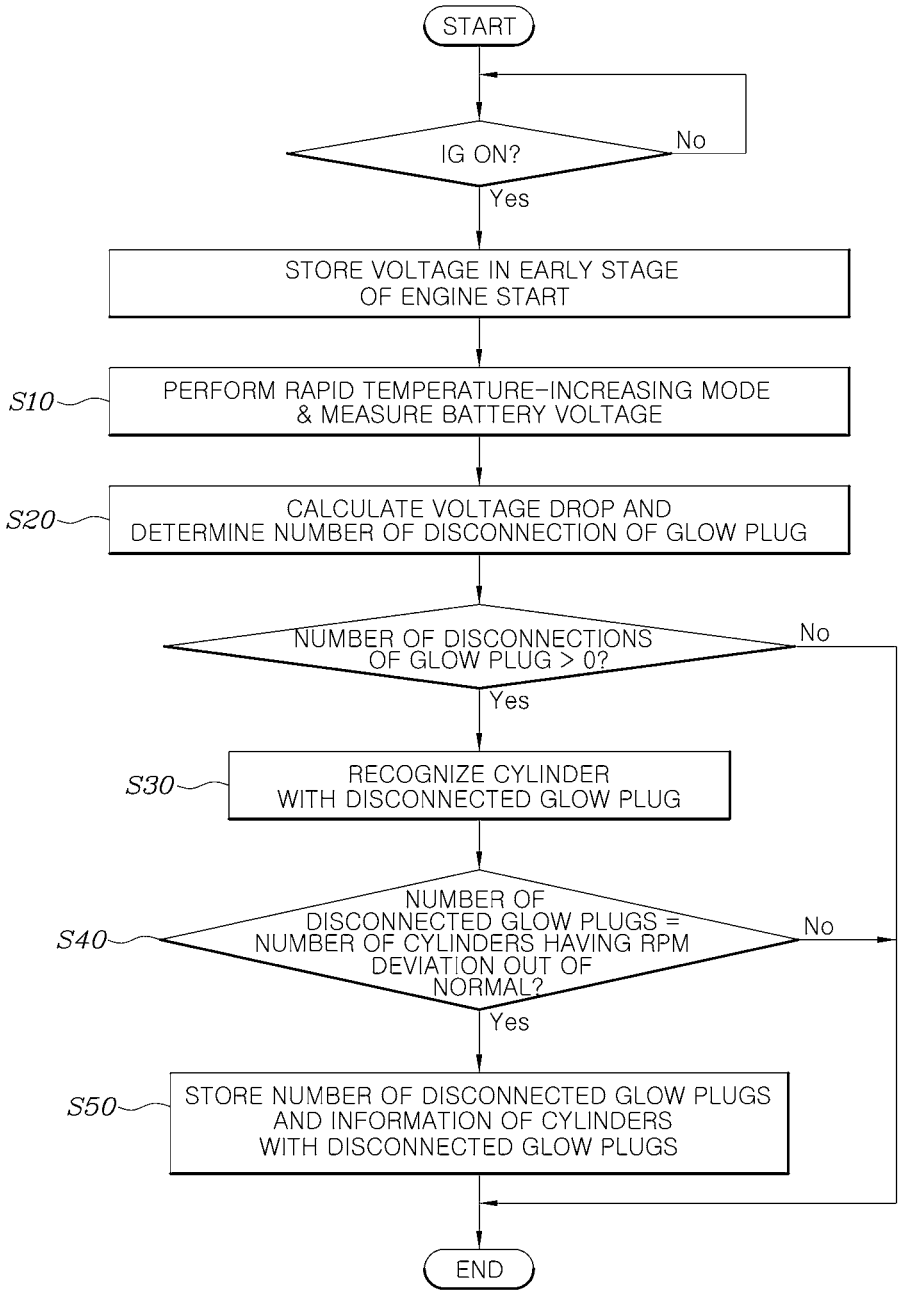
FIG. 2 is a flowchart showing an exemplary embodiment of an engine glow plug disconnection detection method according to various exemplary embodiments of the present invention.

Referring to FIG. 2, an exemplary embodiment of the engine glow plug disconnection detection method of the present invention includes: increasing the temperature of the glow plugs GP by performing a rapid temperature increase mode by the controller when an engine start signal of a vehicle is recognized (S10); determining whether the glow plugs GP are disconnected and the number of disconnections using the engine start early-stage voltage of the vehicle and the voltage when the rapid temperature increase mode is performed, by the controller (S20); recognizing cylinders with a disconnected glow plug GP by the controller upon determining that one or more glow plugs GP are disconnected (S30): and storing, by the controller, the number of disconnected glow plugs GP and the information related to the corresponding cylinders (S50).

That is, according to various exemplary embodiments of the present invention, when the engine of a vehicle is started, the controller is configured to determine whether the glow plugs GP are disconnected, and when glow plugs GP are disconnected, recognizes the number of disconnections and the cylinders having the corresponding glow plugs GP and stores the information, using a change of the battery voltage which is generated when increasing the temperature of the glow plugs GP in the rapid temperature increase mode. Accordingly, only the corresponding glow plugs GP may be easily replaced in later maintenance of the vehicle, whereby convenient maintenance of the vehicle is possible.

When it is determined that one or more glow plugs GP are disconnected, as described above, the controller may induce the driver to have the vehicle repaired by turning on a warning light or generating a warning sound or a guidance voice so that the driver can recognize the situation.

When the engine start signal of the vehicle is recognized, the controller stores the voltage in a battery of the vehicle at that time as the engine start early-stage voltage, measures the voltage of the battery while performing the rapid temperature increase mode, determines a voltage drop of the battery from the engine start early-stage voltage when the rapid temperature increase mode is performed, and determines whether the glow plugs GP are disconnected and the number of disconnections on the basis of the voltage drop.

The rapid temperature increase mode means increasing the temperature of the glow plugs GP up to the level of 1000° C. while applying a battery voltage of 11V or higher for around 3 seconds to the glow plugs GP.

Accordingly, when the controller performs the rapid temperature increase mode, power is simultaneously supplied to several glow plugs GP, so that the voltage of the battery drops. In the instant case, the larger the number of disconnected glow plugs GP, the smaller the voltage drop, and the present physical characteristic is used in various exemplary embodiments of the present invention.

Figure 3:
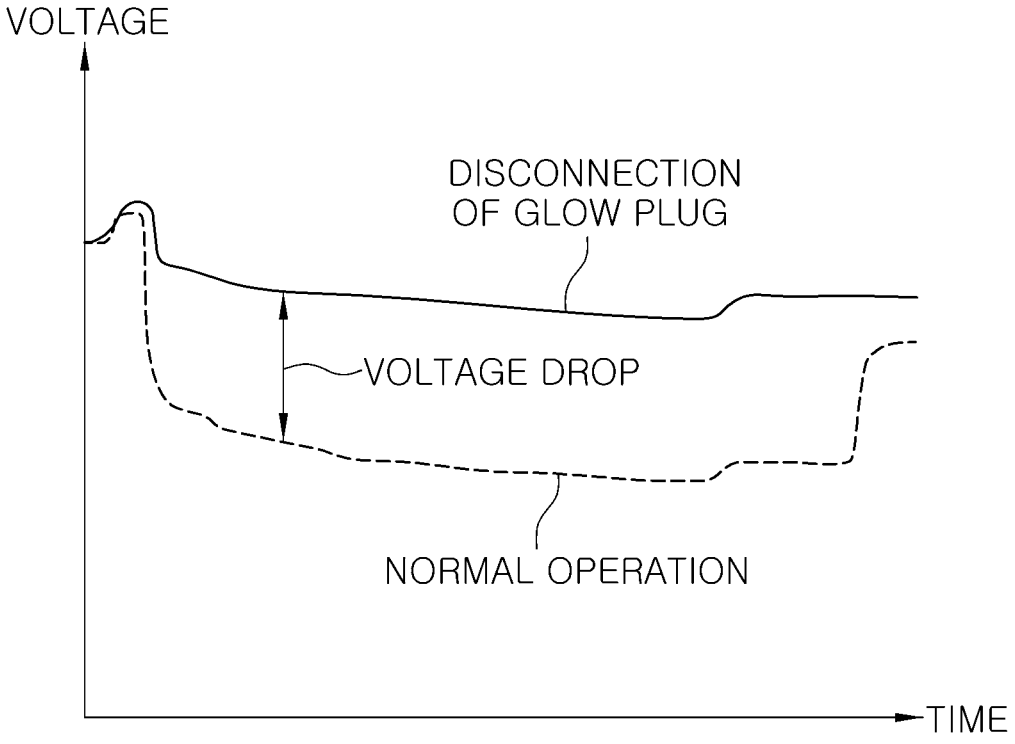
FIG. 3 is a graph showing a voltage drop of a battery in a rapid temperature increasing mode according to various exemplary embodiments of the present invention.

For reference, FIG. 3 is a graph exemplifying a voltage drop in a normal state without any glow plug GP disconnected and the state in which glow plugs GP are disconnected.

The controller is configured to determine the number of disconnected glow plugs GP by comparing the voltage drop with a predetermined disconnection map. The disconnection map is configured to show that the larger the voltage drop, the smaller the number of disconnected glow plugs GP.

That is, the controller obtain the voltage drop of the battery by subtracting the battery voltage when the rapid temperature increase mode is performed from the engine start early-stage voltage, and as shown in FIG. 3, obtains the number of disconnections corresponding to the voltage drop from the disconnection map.

The disconnection map is determined in advance in the design stage through many tests and analysis and is stored in the controller or a separate storage device so that the controller can refer to the disconnection map.

The controller is configured to determine a cylinder at which an RPM deviation of an engine RPM sensor signal is out of a normal range as a cylinder having a disconnected glow plug GP.

That is, when the glow plug GP of a cylinder is disconnected, the rotation speed of the engine crankshaft decreases in the power stroke of the cylinder in comparison to the power cylinder of a normal cylinder due to misfire and the RPM deviation becomes different from the range that normal cylinders show. Accordingly, the cylinder is recognized using the RPM deviation.

Figures 4, 5:
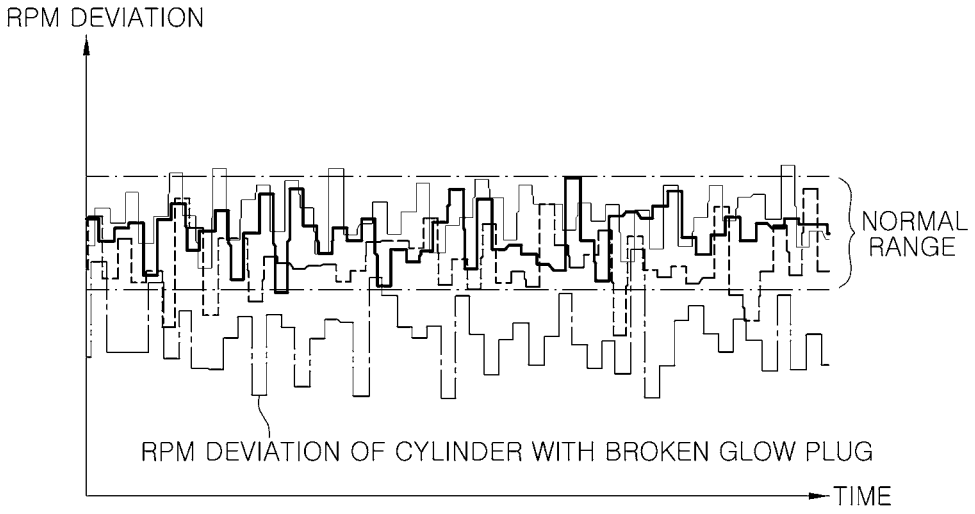
FIG. 4 is a view showing an example of a disconnection map according to various exemplary embodiments of the present invention.
FIG. 5 is a graph showing recognizing a cylinder in which an RPM deviation of an engine RPM sensor signal according to various exemplary embodiments of the present invention is out of a normal range.

For example, FIG. 5 is a graph showing the RPM deviations of cylinders according to a change of time when the glow plug GP of one cylinder is disconnected in an engine including four cylinders. One line which is positioned remarkably down shows a state out of the normal range, which means that the glow plug GP of the corresponding cylinder has been disconnected.

When obtaining the number of disconnected glow plugs GP and the information related to the corresponding cylinders, the controller stores the present information in a storage device, and outputs the number of disconnected glow plugs GP and the information related to the corresponding cylinders together with a breakdown code when the vehicle is repaired so that a repairman can easily and accurately replace only the disconnected glow plugs GP without checking all the glow plugs GP.

The controller is configured to determine whether the number of disconnected glow plugs GP is the same as the number of cylinders at which the RPM deviation is out of the normal range (S40), being able to store the number of the disconnected glow plugs GP and the information related to the corresponding cylinders when the number of the at least a disconnected glow plug and the number of cylinders are a same.

This is for storing only an accurate detection result and using the result for maintenance to prevent an error in maintenance. When the number of glow plugs GP and the number of corresponding cylinders are the same in maintenance, it is possible to make sure of finishing maintenance by accurately replacing on the corresponding glow plugs GP without checking other glow plugs GP.

When the number of disconnected glow plugs GP is not the same as the number of cylinders at which the RPM deviation is out of the predetermined range, the controller may store information indicating that the glow plugs GP of all cylinders have been disconnected.

This is for checking all glow plugs GP in maintenance because it is difficult to accurately determine which glow plugs GP have been disconnected when the number of disconnected glow plugs GP determined on the basis of a voltage drop and the number of cylinders determined on the basis of a deviation of the engine RPM are not same.

When the number of cylinders at which the RPM deviation is out of the predetermined range is greater than the number of disconnected glow plugs GP determined based on a voltage drop, the controller may store information indicating that the glow plugs GP of all cylinders have been disconnected.

In the instant case, it is possible to check the glow plugs GP of all cylinders of which the glow plugs GP have been disconnected or are estimated as being disconnected, so it is possible to further improve the reliability of later maintenance.

The controller may further consider the signal of a vibration sensor that can measure vibration of a cylinder block of the engine upon determining cylinders of which the glow plugs have been disconnected.

For example, when a vibration sensor such as a knock sensor is added to the cylinder block and vibrations of the cylinders in the power stroke are compared by the vibration sensor, it is possible to more surely recognize cylinders with misfire due to disconnection of a glow plug GP.

Furthermore, the term related to a control device such as "controller", "control unit", "control device" or "control module", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present invention. The controller according to exemplary embodiments of the present invention may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors.

The control device may be at least one microprocessor operated by a predetermined program which may include a series of commands for carrying out the method included in the aforementioned various exemplary embodiments of the present invention.

The aforementioned invention can also be embodied as computer readable codes on a computer readable recording medium. The computer readable recording medium is any data storage device that can store data which may be thereafter read by a computer system. Examples of the computer readable recording medium include hard disk drive (HDD), solid state disk (SSD), silicon disk drive (SDD), read-only memory (ROM), random-access memory (RAM), CD-ROMs, magnetic tapes, floppy discs, optical data storage devices, etc and implementation as carrier waves (e.g., transmission over the Internet).

In various exemplary embodiments of the present invention, each operation described above may be performed by a controller, and the controller may be configured by a plurality of controllers, or an integrated single controller.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An engine glow plug disconnection detection method comprising:

increasing, by a controller, temperature of a plurality of glow plugs by performing a rapid temperature increase mode when an engine start signal of a vehicle is recognized by the controller;

determining, by the controller, whether the plurality of glow plugs is disconnected and a number of disconnections using an engine start early-stage voltage of the vehicle and a voltage of the vehicle when the rapid temperature increase mode is performed;

recognizing, by the controller, cylinders of an engine with at least a glow plug upon determining that the at least a glow plug among the plurality of glow plugs is disconnected: and storing, by the controller, a number of the at least a disconnected glow plug and information related to corresponding cylinders, wherein the controller is configured to determine a cylinder at which a revolutions per minute (RPM) deviation of an engine RPM sensor signal is out of a predetermined range as a cylinder having a disconnected glow plug, wherein the controller is configured to determine whether the number of the at least a disconnected glow plug is a same as a number of cylinders at which the RPM deviation is out of the predetermined range, and is configured to store the number of the at least a disconnected glow plug and information related to corresponding cylinders when the number of the at least a disconnected glow plug and the number of cylinders are a same, and wherein when the number of the at least a disconnected glow plug is not the same as the number of cylinders at which the RPM deviation is out of the predetermined range, the controller is configured to store information indicating that the at least a glow plug of all cylinders in the engine has been disconnected.

2. The engine glow plug disconnection detection method of claim 1, wherein when the engine start signal of the vehicle is recognized, the controller is configured:

to store a voltage of a battery in the vehicle as the engine start early-stage voltage, to measure the voltage of the battery while performing the rapid temperature increase mode, to determine a voltage drop of the battery from the engine start early-stage voltage when the rapid temperature increase mode is performed, and to determine whether the at least a glow plug has been disconnected and the number of disconnections of the at least a glow plug according to the voltage drop.

3. The engine glow plug disconnection detection method of claim 2, wherein the controller is configured to determine the number of the at least a disconnected glow plug by comparing the voltage drop with a predetermined disconnection map, and wherein the disconnection map is configured to show that the larger the voltage drop, the smaller the number of the at least a disconnected glow plug.

4. The engine glow plug disconnection detection method of claim 1, wherein when the number of cylinders at which the RPM deviation is out of the predetermined range is greater than the number of the at least a disconnected glow plug, the controller is configured to store information indicating that the at least a glow plug of all cylinders in the engine has been disconnected.

5. The engine glow plug disconnection detection method of claim 1, wherein the controller further considers a signal of a vibration sensor that is configured to measure vibration of a cylinder block of the engine upon determining cylinders of which the at least a glow plug has been disconnected.

6. The engine glow plug disconnection detection method of claim 1, wherein the controller includes:

a processor; and a non-transitory storage medium on which a program for performing the engine glow plug disconnection detection method of claim 1 is recorded and executed by the processor.

7. A non-transitory computer readable medium on which a program for performing the engine glow plug disconnection detection method of claim 1 is recorded.

8. An engine glow plug disconnection detection system comprising:

a crank speed sensor configured to detect a revolution per minute (RPM) of a crankshaft in an engine; and a controller including a processor and connected to the crank speed sensor and configured of receiving a signal of the RPM from the crank speed sensor, wherein the controller is configured:

to increase temperature of a plurality of glow plugs by performing a rapid temperature increase mode when an engine start signal of a vehicle is recognized by the controller;

to determine whether the plurality of glow plugs are disconnected and a number of disconnections using an engine start early-stage voltage of the vehicle and a voltage of the vehicle when the rapid temperature increase mode is performed;

to recognize cylinders of an engine with at least a glow plug upon determining that the at least a glow plug among the plurality of glow plugs is disconnected: and storing a number of the at least a disconnected glow plug and information related to corresponding cylinders, wherein the controller is configured to determine a cylinder at which a revolutions per minute (RPM) deviation of the signal is out of a predetermined range as a cylinder having a disconnected glow plug, wherein the controller is configured to determine whether the number of the at least a disconnected glow plug is a same as a number of cylinders at which the RPM deviation is out of the predetermined range, and is configured to store the number of the at least a disconnected glow plug and information related to corresponding cylinders when the number of the at least a disconnected glow plug and the number of cylinders are a same, and wherein when the number of the at least a disconnected glow plug is not the same as the number of cylinders at which the RPM deviation is out of the predetermined range, the controller is configured to store information indicating that the at least a glow plug of all cylinders in the engine has been disconnected.

9. The engine glow plug disconnection detection system of claim 8, wherein when the engine start signal of the vehicle is recognized, the controller is configured:

to store a voltage of a battery in the vehicle as the engine start early-stage voltage, to measure the voltage of the battery while performing the rapid temperature increase mode, to determine a voltage drop of the battery from the engine start early-stage voltage when the rapid temperature increase mode is performed, and to determine whether the at least a glow plug has been disconnected and the number of disconnections of the at least a glow plug according to the voltage drop.

10. The engine glow plug disconnection detection system of claim 9, wherein the controller is configured to determine the number of the at least a disconnected glow plug by comparing the voltage drop with a predetermined disconnection map, and wherein the disconnection map is configured to show that the larger the voltage drop, the smaller the number of the at least a disconnected glow plug.

11. The engine glow plug disconnection detection system of claim 8, wherein when the number of cylinders at which the RPM deviation is out of the predetermined range is greater than the number of the at least a disconnected glow plug, the controller is configured to store information indicating that the at least a glow plug of all cylinders in the engine has been disconnected.

12. The engine glow plug disconnection detection system of claim 8, further including a vibration sensor, wherein the controller further considers a signal of the vibration sensor that is configured to measure vibration of a cylinder block of the engine upon determining cylinders of which the at least a glow plug has been disconnected.

* * * * *